United States Patent [19]

Prahl et al.

[11] Patent Number: 4,733,532

[45] Date of Patent: Mar. 29, 1988

[54] FLUID POWER TRAIN FOR SMALL APPLIANCES

[75] Inventors: Joseph M. Prahl, East Cleveland; Werner W. Kochte, Ravenna, both of Ohio

[73] Assignee: The Scott Fetzer Company, Westlake, Ohio

[21] Appl. No.: 764,838

[22] Filed: Aug. 9, 1985

[51] Int. Cl.[4] ..... F16D 31/02

[52] U.S. Cl. ..... 60/407; 15/387; 417/423 A

[58] Field of Search ..... 15/387; 417/423 A; 415/206, 191; 60/407

[56] References Cited

U.S. PATENT DOCUMENTS 2,672,281 3/1954 Redding ..... 415/191 X 2,703,904 3/1955 De Long ..... 15/387 X 3,909,875 10/1975 Rother et al. ..... 15/387

4,554,702 11/1985 Kochte et al. ..... 15/387 X

*Primary Examiner*—Edward K. Look

*Attorney, Agent, or Firm*—Pearne, Gordon, McCoy & Granger

[57] ABSTRACT

A fluid power system comprising a fluid pump and an impulse turbine operating in the incompressible domain wherein the pump is characterized by a pressure versus flow curve that is inversely interdependent and by a predetermined pump optimum flow area that is associated with maximum pump output power and the turbine includes an inlet flow path to the turbine rotor the effective area of which is substantially matched to the pump optimum flow area to constrain pump operation to the region of maximum output power.

11 Claims, 6 Drawing Figures

FLUID POWER TRAIN FOR SMALL APPLIANCES

The invention relates to fluid power train systems operating in the so-called incompressible domain. (Although "incompressible domain" is a recognized term of art, it is somewhat misleading since the domain referred to is one in which no significant degree of fluid compression in fact occurs rather than a domain in which the fluid is essentially incompressible. As is well known, in devices that operate in the incompressible domain, even highly compressible fluids such as air remain essentially uncompressed because the fluid flowing through the system experiences a pressure variation whose amplitude is small as compared to the fluid's average absolute pressure.)

More particularly, the invention relates to pump driven impulse turbine appliances of the general type which typically operate in the incompressible domain, and wherein typically the output pressure and flow of the pump are inversely interdependent, such as vacuum powered turbine motor tools or appliances. The invention accomplishes improved turbine power output in such systems.

PRIOR ART

Vacuum powered turbine motor tools or appliances of the foregoing general type are known for example from U.S. Pat. Nos. 3,909,875 to Rother et al., 4,305,176 to Lessig et al. and 4,414,782 to Langenberg. These appliances are driven with air flow induced by conventional vacuum cleaner plants found, for example, in homes, work shops and the like. In general, these appliances operate at a relatively low power level and, consequently, offer limited performance. An underlying cause of this limited power in these tools is the capacity of the vacuum motor or pump. Conventional vacuum pumps are designed primarily, if not exclusively, to produce a suction air flow to entrain dirt or dust particles at the mouth of a suction nozzle. Ordinarily the power level required to accomplish simple suction cleaning is met by a particular vacuum pump fan design without significant reserve power capacity. Typically, the air stream energy produced by the vacuum pump, while adequate for suction cleaning, may be marginal when compared to that required to adequately power a turbine tool. In general, prior art turbine motor appliances, when operated in their intended systems, produce only a fraction of the maximum power output available from the vacuum pump. Since, as mentioned, the maximum fluid power of the typical vacuum cleaning system is limited, a tool utilizing less than this full power is severely handicapped in its work performing capacity.

SUMMARY OF THE INVENTION

The invention provides a method and means for developing a high power level in pump driven impulse turbine devices of the foregoing general type. As stated, the output pressure and flow of the pump in such systems are inversely interdependent. In accordance with the invention, the turbine geometry is matched to the presure/flow characteristics of the pump driving it. More specifically, the turbine inlet area is of a size which constrains pump operation to a region where the product of pump flow and pressure is optimized for high power output.

An example of a pump having an inversely interdependent pressure/flow characteristic is a vacuum cleaner plant ordinarily used for household cleaning. The vacuum fan or pump typically produces maximum pressure at zero flow and zero pressure at maximum flow. Between these limits the pressure and flow are typically inversely related so that from some reference operating point an increase in flow will result in a decrease in pressure and vice versa. Maximum pump output power is normally produced at an operating point somewhere between these extremes of pressure and flow.

Such a pump and a turbine driven thereby operate in the incompressible domain because the maximum suction pressure of the vacuum cleaner plant is small as compared to atmospheric pressure.

A conventional ASTM test can be performed on such a vacuum motor or pump to determine its output power as a function of air flow. This test involves experimental measurement of power at a plurality of flow rates and data derived therefrom can be used to plot a curve of power versus flow rate. Different flow rates are generated by substituting apertures of different areas at the upstream end of the vacuum pump flow path. This plotted curve and another plotting power versus pump flow area reveal a maximum pump output power, a flow rate corresponding to this maximum power output and an optimum pump flow area producing this flow and power.

As suggested above, an impulse turbine power tool driven by air pumped by a vacuum cleaner power plant, in accordance with the invention, has an inlet flow path area at the turbine wheel matched to the optimum pump flow area. The disclosed matched relationship between the turbine inlet flow path area and the vacuum motor unit is applicable to various types and styles of impulse turbine designs. A correction factor can be used to upwardly size the turbine inlet flow path area where guide vanes or other factors hinger inlet flow from that of an unobstructed flow path area. In this case the effective area of the actual turbine inlet flow path is substantially equal to the pump optimum flow area.

Where power falls off only gradually from a maximum value with increasing flow, the turbine inlet flow path area can be increased from a true optimized area without a significant loss in maximum power, in order to reduce the risk of such area being fouled by debris. This limited oversizing of the turbine inlet area can be advantageous when a turbine is exposed to dirty air as in a vacuum sweeper tool or power sander.

In one illustrated embodiment, the turbine motor is provided in a vacuum brush appliance. The appliance is attached to the end of a conventional flexible hose coupled to a vacuum motor. The vacuum brush appliance is hand held to clean above-floor surfaces as well as stair threads and carpet areas requiring special attention.

DESCRIPTION OF THE PREFERRED EMBODIMENTS

Figure 1:
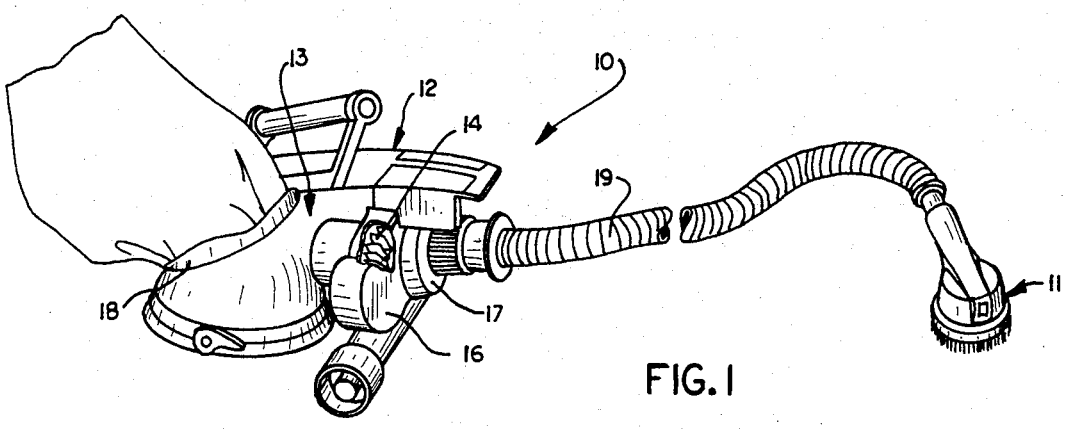
FIG. 1 is a diagrammatic perspective view of a fluid power drive train in the form of an impulse turbine vacuum brush appliance driven by a domestic vacuum cleaner power plant.

Referring now to FIG. 1, there is shown an example of a fluid power system 10 comprising a vacuum brush 11 driven with air flow developed by a vacuum cleaner plant 12. The vacuum cleaner plant 12 is a generally conventional unit which is convertible between an upright floor cleaner and the illustrated portable unit where a front nozzle housing (not shown) is removed. The vacuum cleaner plant 12 includes an electrical motor 13 and a fan 14 driven by the motor operating in a housing 16. When operating, the motor 13 and fan 14, working as a pump, draw air in an inlet 17 and discharge it through an outlet 18. A conventional flexible vacuum hose 19 is coupled at one end to the inlet 17 and at the other end to a tubular handle 21 of the vacuum brush 11. The illustrated vacuum brush 11 represents a unit disclosed in U.S. patent application Ser. No. 639,956, filed Aug. 10, 1984 now U.S. Pat. No. 4,554,702 the disclosure of which is incorporated herein by reference. This vacuum brush 11 includes an impulse turbine motor drive 22 (FIG. 5) having a rotary brush 20 as its load.

It can be generally shown analytically that an air turbine motor, when operated by air flow produced by a conventional vacuum cleaner power plant such as that used in household cleaning, is most effective when the turbine wheel is of the impulse type.

Figure 2:
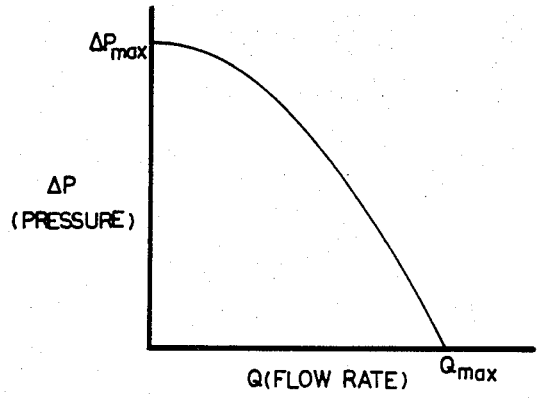
FIG. 2 is a graph plotting output pressure versus output flow of the vacuum cleaner power plant.

A characteristic relationship between the output pressure $\Delta P$ and the output flow Q of the vacuum unit 12 is illustrated in FIG. 2. Pressure $\Delta P$ is the pressure differential below atmospheric pressure reached by the vacuum unit 12. Q is the flow rate of air (e.g. cubic feet per minute) pumped by the vacuum unit 12. As shown in FIG. 2, the pressure $\Delta P$ and flow Q of the vacuum unit 12 are inversely interdependent upon one another, i.e., the pressure/flow curve of FIG. 2 is monotonic.

Figure 3:
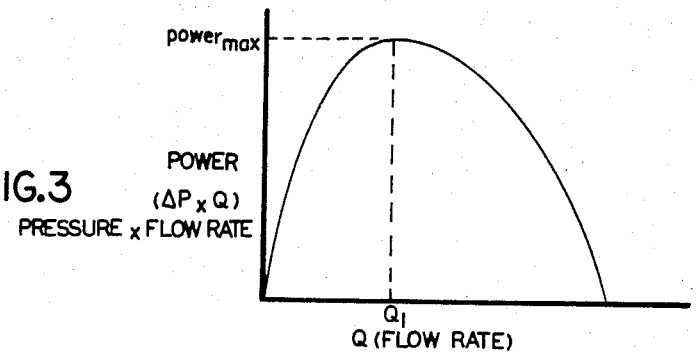
FIG. 3 is a graph plotting output power versus flow of the vacuum cleaner power plant.

FIG. 3 illustrates the output power of the vacuum unit 12 as a function of the flow rate Q of air pumped by the unit. Output power of the vacuum unit 12 is the product of $\Delta P$ times the flow rate Q through the pump. The vacuum pressure of air in the vacuum unit is, for example, in the order of 33 inches $H_2O$, and, consequently, the air flow can be considered to be incompressible.

The pressure versus flow and power versus flow relationships illustrated in FIGS. 2 and 3 as well as a power versus area relationship depicted in FIG. 4 and discussed later can be experimentally determined by testing the vacuum unit 12 on an ASTM standard plenum chamber used to measure vacuum cleaner performance. (ASTM Standard 1982, Vol. 46F 431–79, Standard Performance Measurement Plenum Chamber for Vacuum Cleaners, pages 654–660; ASTM Standard 1982, Vol. 46F 558–78a, Standard Method for Measuring Air Performance Characteristics of Vacuum Cleaners, pages 906–927). The vacuum unit 12 is connected to the plenum chamber through the standard flexible hose 19 so that the measured characteristics of the vacuum unit 12 account for the presence of this hose. An orifice area, opening the plenum to the hose 19, is varied in a sufficient number of increments to produce data for accurately plotting the curves of FIGS. 2 through 4. The plenum aperture areas used in the ASTM plenum chamber are converted to pump flow area for the vacuum unit 12 (inter alia, for the abcissa values in FIG. 4) by multiplying such aperture areas by the coefficient 0.6 to account for vena contracts effects associated with the sharp edges of the plenum apertures.

Study of FIG. 3 reveals that the output power of the vacuum unit 12 reaches a maximum at an intermediate flow rate $Q_1$ i.e. at a flow greater than zero and less than the maximum flow rate produced by the vacuum unit. At this operating point of $Q_1$, the kinetic energy per unit time in the fluid stream produced by the vacuum unit is maximized. In FIG. 4, developed experimentally, the output power of the vacuum unit 12 is shown as a function of pump flow area A (derived from ATM plenum aperture area data). Area $A_1$ in FIG. 4 represents the area which constrains vacuum unit air flow to $Q_1$ (i.e. the flow rate at maximum power output indicated in FIG. 3).

In accordance with the invention, the turbine motor 22 of the vacuum brush 11 is matched to the pressure/flow characteristics of the vacuum unit 12 in a manner whereby the vacuum unit is constrained to operate under pressure and flow conditions corresponding to the region of maximum vacuum unit power output. In particular, the vacuum brush turbine motor 22 is arranged to induce the vacuum unit 12 to develop a flow rate equal to $Q_1$. With the vacuum unit 12 producing its maximum power output, powering of the turbine 22 is maximized.

Figure 5:
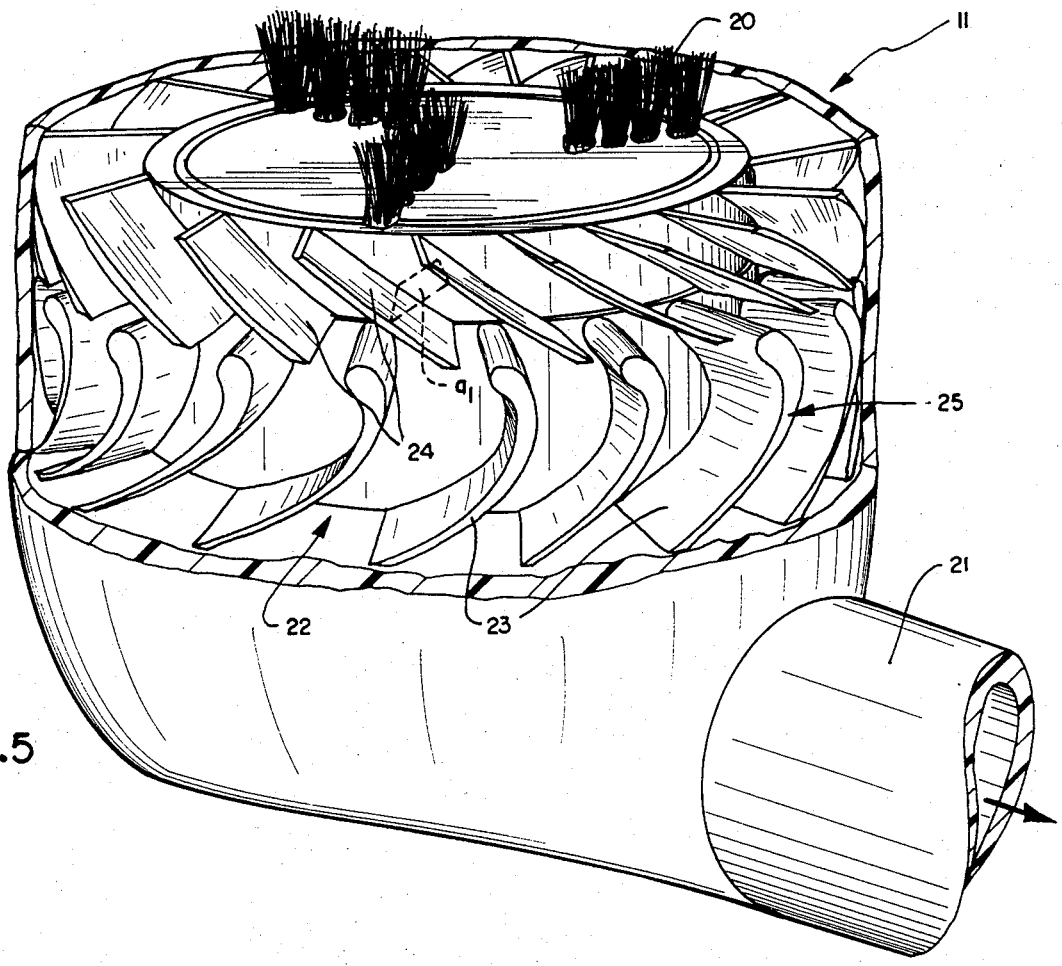
FIG. 5 is a diagrammatic perspective view of the impulse turbine vacuum brush appliance of FIG. 1 on an enlarged scale.

This matching or tuning of the vacuum brush turbine 22 is accomplished by determining an effective total air inlet flow path area $A_{el}$ that is equal to the pump flow area $A_p$, and upsizing $A_{el}$ to an actial total area $A_{al}$ of the inlet flow path to the turbine blades, designated 23. The actual turbine inlet flow path area is measured normal to the fluid flow direction to the impulse turbine blades 23. With reference to FIG. 5, the impulse turbine motor 22 includes a series of stationary inlet guide vanes 24 which are symmetrically arranged in a circular pattern adjacent the path of the rotating impeller blades 23. In this instance, the actual total inlet flow path area $A_{al}$ of the turbine motor 22 is the sum of the individual by adjacent pairs of the inlet guide vanes 24. The guide vanes 24 produce a desired flow direction of air to the rotor blades 23.

Figure 4:
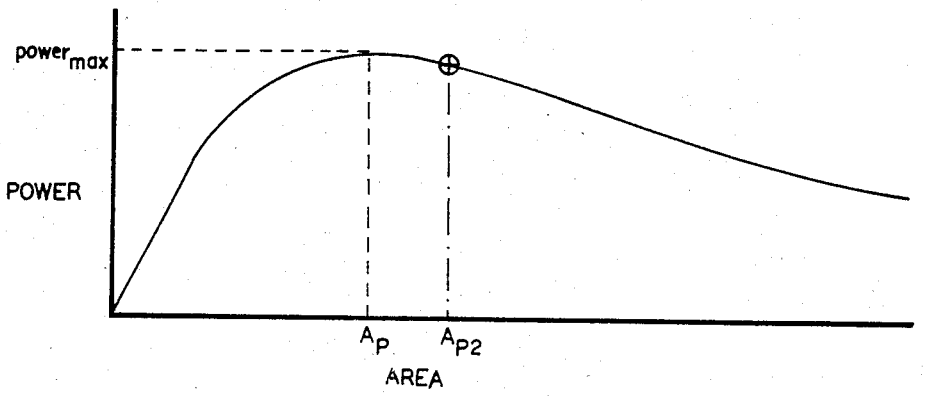
FIG. 4 is a graph plotting output power versus pump flow path area for the vacuum cleaner power plant.

Upsizing from the effective inlet flow path area $A_{el}$ to the actual area $A_{al}$ is required where the inlet includes guide vanes, as in the embodiment of FIG. 5, or where other factors are present which restrict free fluid flow. This correction factor is $\sqrt{1+K_E}$ where the constant $K_E$ is a friction coefficient that can be estimated by analytical methods and/or by experimentation.

Where the inlet includes no guide vanes and no other flow restricting factors are present, no correction factor is required and $A_{al}=A_{el}=A_p$.

Where the power of the vacuum unit 12, as illustrated in FIG. 4, does not decrease appreciably from its maximum Power $_{max.}$ with moderate increases in area A from $A_p$, an increased actual area $A_{a2}$ greater than $A_{al}$ can be used for sizing the total flow path area of the inlet to the turbine motor 22. This oversizing to $A_{a2}$ can be desirable where the turbine motor is drawing in dirty air as in a vacuum brush application and there is a risk that the inlet area could be fouled by debris.

Figure 6:
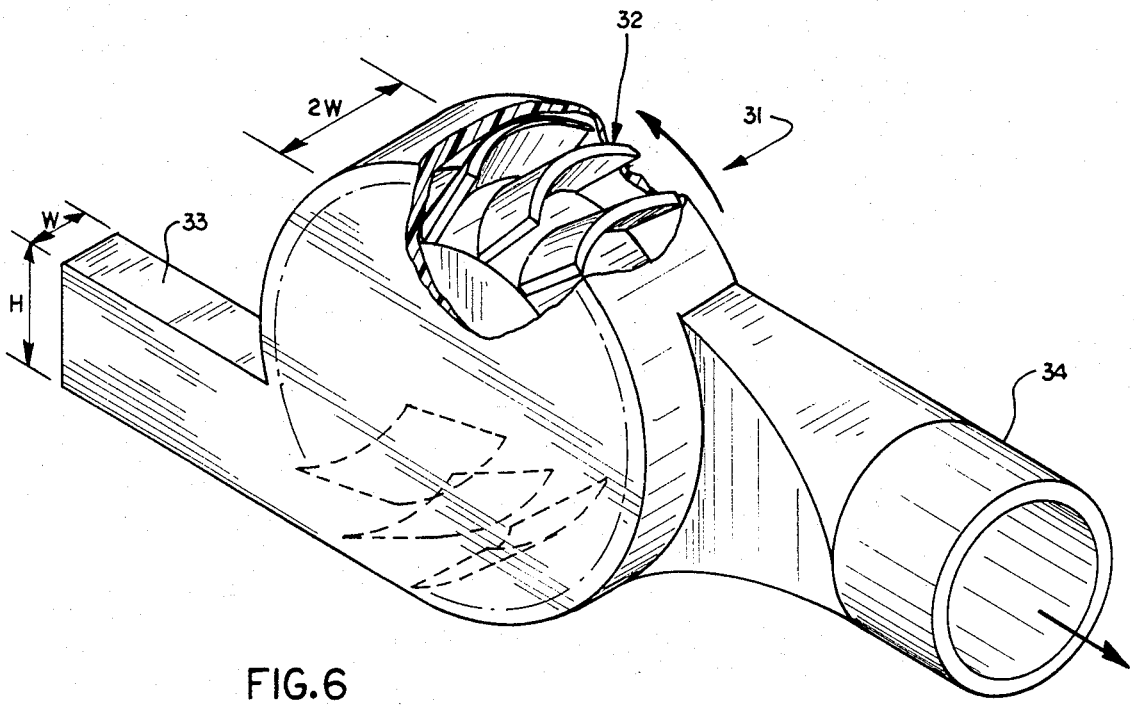
FIG. 6 is a diagrammatic perspective view of an impulse turbine of a style different from that of FIG. 5.

By way of example, one fluid power system represented by FIGS. 1–5 had the following approximate properties:

$\Delta P_{max}=34$ in $H_2O$
$Q_{max}=90$ cfm
$K_E=1.2$
Actual area $A_{a1}=0.58$ in$^2$
Actual area $A_{a2}=0.86$ in$^2$ Referring now to FIG. 6, there is schematically shown an impulse turbine motor 31 which differs, from that of FIG. 5. In this embodiment, air enters the turbine 32 in a path generally tangential to the turbine and in a direction generally transverse to the axis of rotation of the turbine or impeller rotor. The turbine motor 31 schematically represents the type of unit disclosed, for example, in aforementioned U.S. Pat. No. 4,305,176. The total inlet flow path area is formed by a channel diagrammatically represented at 33. The channel 33 directs or guides air generally tangentially to the impeller rotor 32 at a zone which is a relatively small fraction of the periphery of the rotor. FIG. 5 illustrates a simplified case where the inlet flow path channel 33 is rectangular so that its area is the product of its width W times its height H.

In accordance with the present invention, the dimensions of the inlet channel 33 normal to the flow path are arranged to produce an effective area substantially equal to $A_p$ determined for the vacuum unit 12. Where the impulse turbine motor 31 exhibits a characteristic power curve like that illustrated in FIG. 4 and the motor is drawing dirty air, the effective total area used for the inlet channel 33 can be an area, $A_{e2}$, corresponding to $A_{p2}$ in FIG. 4, and such area $A_{e2}$ is upsized by the flow correction factor $\sqrt{1+K_E}$ where appropriate to an actual total inlet area $A_{a2}$. Air is discharged through the vacuum unit 12 from an outlet of the turbine motor 31 shown schematically at 34.

It is contemplated that a manufacturer practicing the present invention can produce a "universal" impulse turbine appliance for use with a variety of vacuum power plants, each with inversely interdependent but different pressure/flow characteristics. The motor, housing, impeller rotor and the like of the turbine motor can be essentially the same and only the inlet flow path area need be changed to suit a particular vacuum cleaner plant. The area can be determined at the time of manufacture or can be set by the ultimate consumer by substituting, altering, adjusting or otherwise modifying elements in the flow path area.

The above described principles of the invention are applicable to systems operating at above atmospheric pressure such as where an impulse turbine is driven by positive pressure.

Although the preferred embodiments of this invention have been shown and described, it should be understood that various modifications and rearrangements of the parts may be resorted to without departing from the scope of the invention as disclosed and claimed herein.

What is claimed is:

1. A matched pump and turbine motor set operating in the incompressible domain and developing a high power level comprising a pump which produces an output pressure that is inversely interdependent on its output flow and produces a maximum of output power as the product of its pressure and flow when its flow is constrained to pass through a predetermined optimum area, the turbine motor having a rotor of the impulse type and an inlet flow path for fluid entering the turbine motor, the flow path having an effective area normal to the entering flow sufficiently close in size to the optimal area that when pumping fluid through the turbine motor the pump is induced to operate substantially at its maximum output power level, and means coupling an inlet and an outlet of the pump and motor for fluid flow therebetween.

2. A pump and turbine motor set as in claim 1, wherein the entering fluid flow is formed by a plurality of passages disposed about the axis of rotation of the rotor.

3. A pump and turbine motor set as in claim 2, wherein the plurality of passages are divided from one another by intervening guide vanes.

4. A pump and turbine motor set as in claim 1, wherein the entering fluid flow path is formed by a single channel directing fluid flow towards a relatively small portion of a peripheral extent of the rotor.

5. A pump driven impulse turbine appliance comprising fluid pump means operating in the incompressible domain, an impulse turbine driven by the fluid pumped by the pump means, means coupling the pump and the turbine for fluid flow therebetween, and a load driven by the turbine, said fluid pump means being characterized by a pressure versus flow curve that is inersely interdependent and by a pump optimum area that is associated with maximum power (pressure times flow), said turbine including a turbine rotor and inlet means, said inlet means defining an inlet flow path to the turbine rotor, the effective area of said inlet flow path being substantially equal to or moderately larger than the pump optimum area.

6. A method of developing a high level of power in a system operating in the incompressible domain and having a rotary inpule turbine driven by a fluid pump with an inversely interdependent pressure flow output which comprises selecting a total inlet flow path area for the entrance to the turbine rotor that restricts fluid flow developed by the pump to a value that produces a power output, as the product of pressure and flow at the pump, that is substantially maximized.

7. A method as set forth in claim 6, including the step of providing the turbine with inlet guide means that forms the inlet flow path area.

8. A method as set forth in claim 7, including the step of forming the inlet guide means of a plurality of inlet guide vanes.

9. A method as set forth in claim 7, including the step of distributing said guide means at a plurality of separate points adjacent the periphery of the turbine rotor.

10. A method as set forth in claim 6, including the step of selecting the area of the inlet flow path by increasing an optimum area by a multiplying factor of $\sqrt{1+K_E}$ to account for restriction of flow in the inlet flow path.

11. A method as set forth in claim 6, including the step of selecting an area for the inlet flow path moderately larger than that which produces maximuj power to decrease the risk of fouling the turbine where the turbine is exposed to dirty air and where the pump is of a type in which its power level decreases in a relatively small degree with moderate increases in flow beyond that of maximum pump output power.

* * * * *